US006923099B2

(12) United States Patent
Rugg et al.

(10) Patent No.: US 6,923,099 B2
(45) Date of Patent: Aug. 2, 2005

(54) SCRAPBOOKING INSTRUMENT SET

(76) Inventors: Julie Rugg, 864 W. Clover Meadow Cir., Murray, UT (US) 84123; Lisa Ann Jarvis, 75 E. Wicker La., Bountiful, UT (US) 84010

( * ) Notice: Subject to any disclaimer, the term of this patent is extended or adjusted under 35 U.S.C. 154(b) by 0 days.

(21) Appl. No.: 10/621,650

(22) Filed: Jul. 16, 2003

(65) Prior Publication Data

US 2004/0118723 A1 Jun. 24, 2004

Related U.S. Application Data

(60) Provisional application No. 60/396,857, filed on Jul. 17, 2002.

(51) Int. Cl.[7] ..... B25F 3/00

(52) U.S. Cl. ..... 83/13; 7/158; 30/123; 81/439

(58) Field of Search ..... 7/158; 30/123; 81/439; 83/13

(56) References Cited

U.S. PATENT DOCUMENTS 428,150 A * 5/1890 Glover ..... 297/366
532,823 A * 1/1895 Sanger ..... 81/177.4
4,572,038 A * 2/1986 Graham ..... 81/439
6,352,011 B1 * 3/2002 Fruhm ..... 81/438

* cited by examiner

*Primary Examiner*—Charles Good
(74) *Attorney, Agent, or Firm*—Clayton, Howarth & Cannon, P.C.

(57) ABSTRACT

A scrapbooking instrument set comprises three elongated hole punches of different bit sizes and three elongated setters of different bit sizes, each hole punch and setter of substantially identical size and shape except for the bits. The hole punches and setters are arranged in a base, in a circle around a larger mounting tool configured with an axially extending hole of identical radial shape and slightly larger radial size as the hole punches and setters, such that the hole punches and setters each fit inside the tool. The base contains holes into which the hole punches, setters and mounting tool fit, such that the hole punches, setters and mounting tool are stored vertically in the base. A transparent cover screws onto the base to protect the instruments stored therein while allowing them to be displayed.

20 Claims, 2 Drawing Sheets

SCRAPBOOKING INSTRUMENT SET

CROSS-REFERENCE TO RELATED APPLICATIONS

This application claims the benefit of U.S. Provisional Application No. 60/396,857, filed Jul. 17, 2002.

STATEMENT REGARDING FEDERALLY SPONSORED RESEARCH OR DEVELOPMENT

Not applicable.

BACKGROUND OF THE INVENTION

This invention relates to making and using scrapbooks. More particularly, this invention relates to instruments and methods for making and using scrapbooks.

From small beginnings in the early 1990s, the scrapbooking industry has exploded into a multi-billion-dollar industry. Methods of constructing scrapbook pages have evolved from simply cutting and pasting to ever-more-elaborate decorations, with various borders, attachments, covers, layouts, etc.

One popular method of constructing and embellishing scrapbook pages uses eyelets made of metal or other malleable material to attach different sections of the page together. Since eyelets are manufactured in various decorative shapes, they may also be used simply for decoration.

The eyelets are installed by first punching a properly sized hole out of the page material, be it paper, pasteboard, cardboard, foam, or other material. Using a tool known in the industry as a setter, the scrapbooker then installs the eyelet.

Scrapbookers have been inconvenienced, however, with the varying sizes of hole punches and setters to accommodate differently sized eyelets. Scrapbookers must individually purchase three or four different hole punches and three or four different setters. Storing the hole punches and setters is inconvenient and damaging, since most storage methods comprise laying the instruments loosely in storage compartments where their sharp edges, necessary for effective work, are dulled and otherwise damaged.

The present invention provides an apparatus whereby hole punches and setters of varying sizes can be sold and used in a single unit, and provides an apparatus for storing the instruments wherein they are free from damage and wear other than from their intended uses, by storing them vertically and spaced from each other.

Various patents describe interchangeable bits for tools into a common mount. Fruhm, U.S. Pat. No. 6,352,011 B1, describes two-ended screwdriver bits, either end of which can be inserted and used in a mounting tool. Sanger, U.S. Pat. No. 532,823, describes a multiple screwdriver wherein various bits can be inserted. Glover, U.S. Pat. No. 438,150, describes a tool holder wherein various tools can be mounted. Graham, U.S. Pat. No. 4,572,038, describes a multi-purpose tool wherein various tips are stored. A rotational apparatus exposes the needed tip for the job. Lin, U.S. Pat. No. 4,480,668, describes a screwdriver kit containing four driver blades in a magazine tube inside the handle, wherein the handle can be manipulated to cause the desired driver blade to protrude out of the handle. Hsiao, U.S. Pat. No. 6,363,820 B1, describes a hand tool for driving a fastener about an axis wherein a handle contains an axially extending bore which receives a fastener engaging member, ensuring engagement with an annular deformable member inside the bore. The engaging member receives various bits.

No one, however, has ever put scrapbooking tools into such a configuration, as the present invention does. In addition, no one has provided for the present invention's particular type of storage apparatus for scrapbooking tools.

In view of the foregoing, it will be appreciated that providing a scrapbooking instrument set and method would be a significant advancement in the art.

BRIEF SUMMARY OF THE INVENTION

An illustrative embodiment of the present invention comprises a handheld combination hole puncher and eyelet setter tool comprising:

an elongated handle having a first end and a second end, wherein the first end comprises an axially extending hole and the second end is adapted to receive an impact force;

a plurality of interchangeable hole punches and setters, each of the hole punches and setters adapted to be slidably mounted in the axially extending hole; and a holder disposed in the axially extending hole whereby a hole punch or setter mounted in the axially extending hole is removably held in place such that when the impact force is delivered to the second end of the elongated handle, the impact force is transferred to the hole punch or setter.

In certain embodiments of the invention, this tool further comprises an air pressure relief hole in communication with the axially extending hole, and the elongated handle is substantially cylindrical in shape. The holder can be an o-ring, for example. The hole punches illustratively comprise a cylindrical shank having a bit at one end. The bit comprises a sharp annular edge for cutting. The hole punches further comprise a disposal tunnel extending from the sharp annular edge through the cylindrical shank to a disposal hole thereby providing an exit for cut material. The setters comprise a cylindrical shaft having a bit at one end, the bit adapted to set eyelets.

Another illustrative embodiment of the invention comprises a storage apparatus for storing a handheld combination hole puncher and eyelet setter tool and a plurality of hole punches and setters, the apparatus comprising:

a cylindrical base having a top, a bottom, and a side wall;

a main hole in the top of the base adapted to receive the handheld combination hole puncher and eyelet setter tool such that the handheld combination hole puncher and eyelet setter tool is maintained in an upright position; and a plurality of secondary holes in the top of the base, each of the secondary holes adapted to receive one of the hole punches or setters.

The storage apparatus can further comprise a cover, the cover being cylindrical in shape and having a closed top and an open bottom, the cover being transparent. The cover can also comprise a threaded portion, wherein the cylindrical base further comprises a set of threads in the side wall, and the threaded portion of the cover is adapted to rotatably engage the set of threads in the side wall of the base. Various materials may be used for fabricating the base, but a foam material is one illustrative material that can be used.

Another illustrative aspect of the invention comprises a method for installing an eyelet into a piece of material using a combination hole punch and eyelet setter tool, said method comprising:

selecting a hole punch corresponding in size to the eyelet and installing it into the combination hole punch and eyelet setter tool;

punching a hole in the material at the desired location by striking the combination hole punch and eyelet setter tool with a mallet or hammer such that the hole punch cuts the material;

interchanging the hole punch with a setter of corresponding size in the combination hole punch and eyelet setter tool; and setting the eyelet using the setter installed in the combination hole punch and eyelet setter by striking the combination hole punch and eyelet setter with a mallet or hammer such that the setter sets the eyelet.

Still another illustrative embodiment of the invention comprises a hole puncher and eyelet setter kit comprising:

a handheld combination hole puncher and eyelet setter tool comprising an elongated handle having a first end and a second end, wherein the first end comprises an axially extending hole and the second end is adapted to receive an impact force, a plurality of interchangeable hole punches and setters, each of the hole punches and setters adapted to be slidably mounted in the axially extending hole, and a holder disposed in the axially extending hole whereby a hole punch or setter mounted in the axially extending hole is removably held in place such that when the impact force is delivered to the second end of the elongated handle, the impact force is transferred to the hole punch or setter; and a storage apparatus comprising a cylindrical base having a top, a bottom, and a side wall, a main hole in the top of the base adapted to receive the handheld combination hole puncher and eyelet setter tool such that the handheld combination hole puncher and eyelet setter tool is maintained in an upright position, and a plurality of secondary holes in the top of the base, each of the secondary holes adapted to receive one of the plurality of hole punches and setters.

DETAILED DESCRIPTION

Before the present scrapbooking instrument set and method are disclosed and described, it is to be understood that this invention is not limited to the particular configurations, process steps, and materials disclosed herein as such configurations, process steps, and materials may vary somewhat. It is also to be understood that the terminology employed herein is used for the purpose of describing particular embodiments only and is not intended to be limiting since the scope of the present invention will be limited only by the appended claims and equivalents thereof.

The publications and other reference materials referred to herein to describe the background of the invention and to provide additional detail regarding its practice are hereby incorporated by reference. The references discussed herein are provided solely for their disclosure prior to the filing date of the present application. Nothing herein is to be construed as an admission that the inventors are not entitled to antedate such disclosure by virtue of prior invention.

It must be noted that, as used in this specification and the appended claims, the singular forms "a," "an," and "the" include plural referents unless the context clearly dictates otherwise. Thus, for example, reference to a handheld combination hole puncher and eyelet setter tool comprising "a holder" includes references to such a tool comprising two or more of such holders, reference to "an impact force" includes reference to one or more of such impact forces, and reference to an air pressure relief hole includes reference to two or more of such air pressure relief holes.

In describing and claiming the present invention, the following terminology will be used in accordance with the definitions set out below.

As used herein, "comprising," "including," "containing," "characterized by," and grammatical equivalents thereof are inclusive or open-ended terms that do not exclude additional, unrecited elements or method steps. "Comprising" is to be interpreted as including the more restrictive terms "consisting of" and "consisting essentially of."

As used herein, "consisting of" and grammatical equivalents thereof exclude any element, step, or ingredient not specified in the claim.

As used herein, "consisting essentially of" and grammatical equivalents thereof limit the scope of a claim to the specified materials or steps and those that do not materially affect the basic and novel characteristic or characteristics of the claimed invention.

Figure 1:
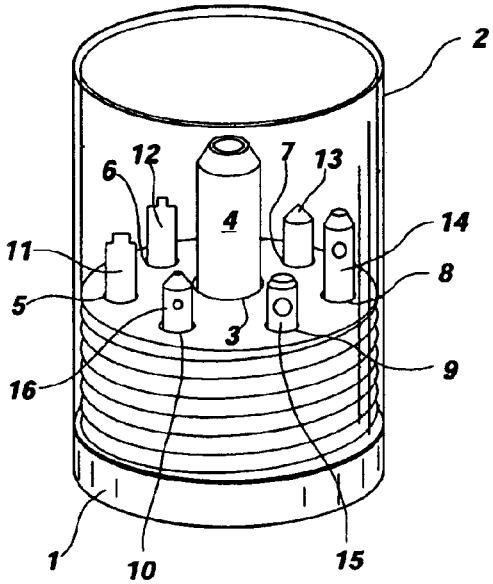
FIG. 1 is a perspective view of the scrapbooking instrument set, showing the base, with the cover screwed on, and the mounting tool, hole punches and setters stored vertically in the base.

Referring to FIG. 1, an illustrative aspect of the invention comprises a cylindrical base 1, covered by a cylindrical transparent cover 2. The base contains a vertical cylindrical central hole 3, into which a cylindrical mounting tool 4 is placed. Around the central hole 3 are placed, in circular arrangement, holes 5, 6, 7, 8, 9 and 10, which are of substantially equal size and shape. Into holes 5, 6, 7, 8, 9, 10 are vertically placed a large setter 11, a medium setter 12, a universal setter 13, a medium hole punch 14, a large hole punch 15, and a small hole punch 16, respectively. Hole punches 14, 15, 16 and setters 12, 13, 14, except for their different bits located on one end of each instrument thereof, are of substantially equal length and diameter, such that they can be placed interchangeably into holes 5, 6, 7, 8, 9, 10, and such that they each fit into mounting tool 4.

Figure 2:
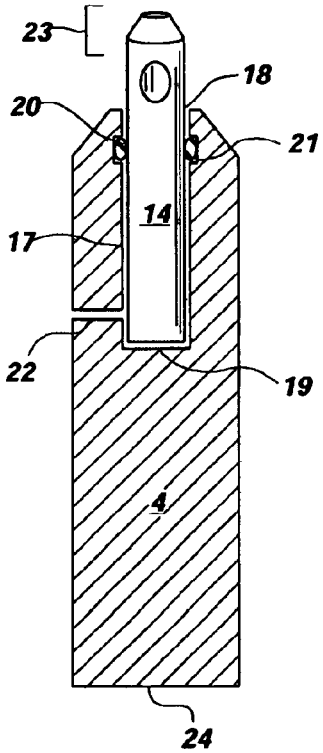
FIG. 2 is an elevation cutaway view of the mounting tool, with a hole punch or setter mounted into it.

FIG. 2 shows medium hole punch 14 mounted in mounting tool 4, although any one of hole punches 14, 15, 16 or setters 11, 12, 13 could just as easily be shown. Mounting tool 4 is, in an illustrative embodiment, made of hardened steel, and has an axially extending cylindrical hole 17, extending from an open end 18 to a closed end 19 within mounting tool 4. Hole 17 is of substantially equal shape and of slightly larger diameter than setters 11, 12, 13 and hole punches 14, 15, 16. A conformable O-ring 20 made of rubber or similar material is placed within hole 17 in a seating groove 21 to grip hole punch 14 securely. A small hole 22 leads from hole 17 to the outer surface of mounting tool 4 to relieve air pressure changes in hole 17 when hole punch 14 is installed or removed.

Mounting tool 4 thus allows for interchangeable installation and removal of setters 11, 12, 13 and hole punches 14, 15, 16, allowing the setters and hole punches to be smaller than they would otherwise have to be, which in turn allows for convenient packaging of multiple setters and hole punches. Thus the setters and hole punches can be stored vertically and spaced from each other to avoid damage and possible loss of one or more instruments.

When a hole punch or setter is placed in mounting tool 4 as described above, the user can then place the exposed end 23 against the paper or eyelet or other material to be manipulated, and strike the opposite end 24 of mounting tool 4 with a mallet or hammer to achieve the desired effect.

Figure 3:
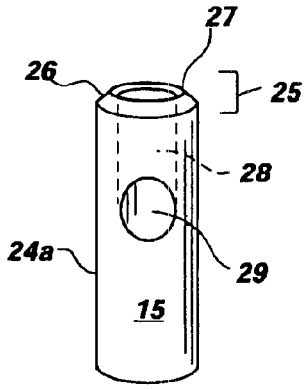
FIG. 3 is an elevation cutaway view of a large hole punch.
Figure 4:
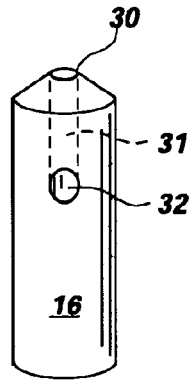
FIG. 4 is an elevation cutaway view of a small hole punch.
Figure 5:
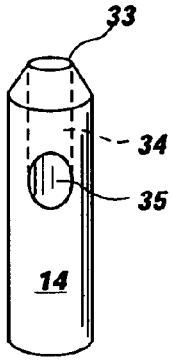
FIG. 5 is an elevation cutaway view of a medium hole punch.

FIGS. 3, 4, and 5 show large hole punch 15, small hole punch 16, and medium hole punch 14, respectively. The hole punches are made of hardened steel in an illustrative embodiment. All three hole punches 14, 15, 16 are similarly constructed. Referring to FIG. 3, hole punch 15 comprises a cylindrical shank 24*a* and bit 25 located on one end of shank 24*a*. Bit 25 comprises an annular bevel 26 leading from shank 24*a* to a sharp annular edge 27, which is placed under sharp pressure against paper or other material to create a hole therein. A disposal tunnel 28 leads through shank 24*a* from annular edge 27 to disposal hole 29, providing an exit for cut material wedging itself within edge 27 when hole punch 15 is in use.

In use, shank 24*a* is placed in hole 17 of mounting tool 4, being secured by O-ring 20 (FIG. 2), with bit 25 exposed.

Referring to FIG. 4, small hole punch 16 is constructed identically to large hole punch 15, except that hole punch 16's sharp annular edge 30 is smaller in diameter than annular edge 27 (FIG. 3). Disposal tunnel 31 and disposal hole 32 are also smaller than their counterparts in FIG. 3 (tunnel 28 and hole 29).

Referring to FIG. 5, medium hole punch 14 is constructed identically to large hole punch 15 and small hole punch 16, except that hole punch 14's sharp annular edge 33 is smaller in diameter than annular edge 27 (FIG. 3) and larger in diameter than annular edge 30 (FIG. 4). Disposal tunnel 34 and disposal hole 35 correspond in size to annular edge 33.

As their names imply, large hole punch 15, small hole punch 16 and medium hole punch 14 create large, small and medium holes, respectively, when used with mounting tool 4.

Figure 6:
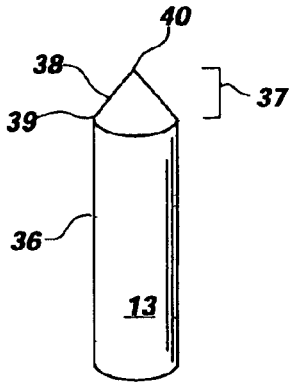
FIG. 6 is an elevation view of a universal setter.

FIG. 6 shows universal setter 13, which, when mounted in mounting tool 4, is used to secure small or odd-sized eyelets through holes created by hole punches 14, 15 or 16. Universal setter 13 comprises a shank 36 and bit 37 disposed on one end of shank 36. Bit 37 comprises a cone 38 whose lower edge 39 meets shank 36 and which ends in a point 40. In an illustrative embodiment, universal setter 13, along with large setter 11 and medium setter 12, is made of hardened steel to withstand wear occasioned by use with mounting tool 4.

Figure 7:
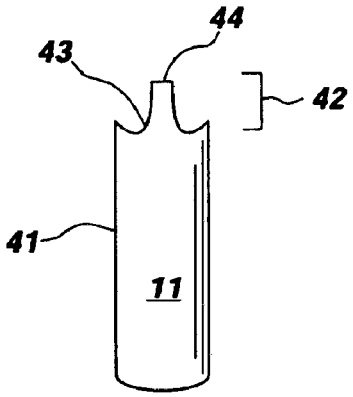
FIG. 7 is an elevation view of a medium setter.

FIG. 7 shows large setter 11, which, when mounted in mounting tool 4, is used to secure large eyelets. Large setter 11 comprises a shank 41 and a bit 42 disposed on one end of shank 41. Bit 42 comprises an annular groove 43 and a circular central protrusion 44 in the center of groove 43.

Figure 8:
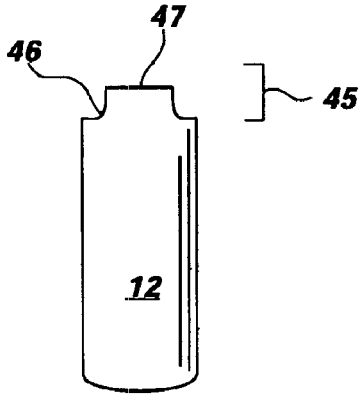
FIG. 8 is an elevation view of a large setter.

FIG. 8 shows medium setter 12, which is constructed substantially identically to large setter 11 except that its bit 45 has an annular groove 46 narrower in width than annular groove 43 (FIG. 7), leaving a central protrusion 47 larger in diameter than central protrusion 44 (FIG. 7). When mounted in mounting tool 4, medium setter 12 is used to secure medium-size eyelets.

Figure 9:
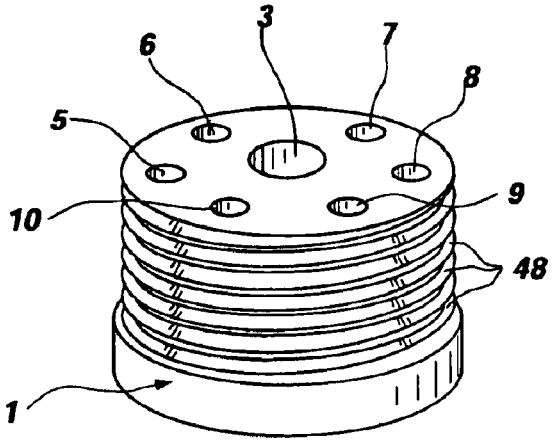
FIG. 9 is a perspective view of the base.

FIG. 9 shows base 1, which is constructed of foam or similar material in an illustrative embodiment. Base 1 is cylindrical in shape, with threads 48 running around it in order to enable cover 2 to screw onto it. At the top and center of base 1 is located hole 3, cylindrical in shape and axially disposed into base 1. Hole 3 is shaped and sized such that mounting tool 4 fits into it vertically for storage. Surrounding hole 3 in circular arrangement are holes 5, 6, 7, 8, 9, 10, which are cylindrically shaped and sized slightly larger than hole punches 14, 15, 16 and setters 11, 12, 13, respectively, such that each of the hole punches and setters fit into each hole for vertical storage.

Figure 10:
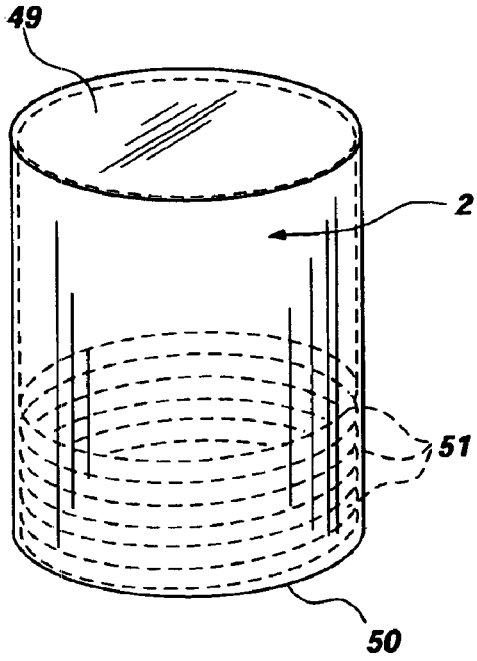
FIG. 10 is a perspective view of the cover.

FIG. 10 shows cover 2, which is cylindrical in shape and hollow, with a closed top 49 and open bottom 50. Cover 2 is constructed of clear plastic in the preferred embodiment, such that the user can see the instruments therein without removing the cover. Cover 2 is fitted with threads 51 on its lower half, which screw onto threads 48 on base 1 (FIG. 9).

What is claimed is:

1. A method for installing an eyelet into a piece of material using a combination hole punch and eyelet setter, said method comprising:

selecting a hole punch corresponding in size to the eyelet and installing it into the combination hole punch and eyelet setter tool;

punching a hole in the material at the desired location by striking the combination hole punch and eyelet setter tool with a mallet or hammer such that the hole punch cuts the material;

interchanging the hole punch with a setter of corresponding size in the combination hole punch and eyelet setter tool; and setting the eyelet using the setter installed in the combination hole punch and eyelet setter by striking the combination hole punch and eyelet setter with a mallet or hammer such that the setter sets the eyelet.

2. A handheld combination hole puncher and eyelet setter tool comprising:

an elongated handle having a first end and a second end, wherein said first end comprises an axially extending hole and said second end is adapted to receive an impact force;

a plurality of interchangeable hole punches and setters, each of said hole punches and setters adapted to be slidably mounted in said axially extending hole; and a holder disposed in said axially extending hole whereby a hole punch or setter mounted in said axially extending hole is removably held in place such that when said impact force is delivered to the second end of the elongated handle, said impact force is transferred to said hole punch or setter.

3. The handheld combination hole puncher and eyelet setter tool of claim 1 further comprising an air pressure relief hole in communication with said axially extending hole.

4. The handheld combination hole puncher and eyelet setter tool of claim 1 wherein the elongated handle is substantially cylindrical in shape.

5. The handheld combination hole puncher and eyelet setter tool of claim 1 wherein each of the plurality of hole punches comprises a cylindrical shank having a bit at one end.

6. The handheld combination hole puncher and eyelet setter tool of claim 5 wherein the bit comprises a sharp annular edge for cutting.

7. The handheld combination hole puncher and eyelet setter tool of claim 6 wherein each of the plurality of hole punches further comprises a disposal tunnel, said disposal tunnel extending from the sharp annular edge through the cylindrical shank to a disposal hole thereby providing an exit for cut material.

8. The handheld combination hole puncher and eyelet setter tool of claim 6 wherein the plurality of hole punches comprise bits of different size.

9. The handheld combination hole puncher and eyelet setter tool of claim 1 wherein each of the plurality of setters comprises a cylindrical shaft having a bit at one end, said bit adapted to set eyelets.

10. The handheld combination hole puncher and eyelet setter tool of claim 1 wherein the holder comprises an o-ring.

11. An apparatus for storing a handheld combination hole puncher and eyelet setter tool and a plurality of hole punches and setters, said apparatus comprising:

a cylindrical base having a top, a bottom, and a side wall;

a main hole in the top of said base adapted to receive said handheld combination hole puncher and eyelet setter tool such that said handheld combination hole puncher and eyelet setter tool is maintained in an upright position; and a plurality of secondary holes in the top of said base, each of said secondary holes adapted to receive one of said hole punches or setters.

12. The apparatus of claim 11 further comprising a cover, said cover being cylindrical in shape having a closed top and an open bottom, said cover being transparent.

13. The apparatus of claim 12 wherein said cover comprises a threaded portion and wherein the cylindrical base further comprises a set of threads in the side wall, said threaded portion of the cover adapted to rotatably engage the set of threads in the side wall of the base.

14. The apparatus of claim 11 wherein the base is comprised of foam.

15. The apparatus of claim 11 wherein the main hole is located in the center of the base and the secondary holes are circularly arranged around the main hole.

16. A hole puncher and eyelet setter kit comprising:

a handheld combination hole puncher and eyelet setter tool comprising an elongated handle having a first end and a second end, wherein said first end comprises an axially extending hole and said second end is adapted to receive an impact force, a plurality of interchangeable hole punches and setters, each of said hole punches and setters adapted to be slidably mounted in said axially extending hole, and a holder disposed in said axially extending hole whereby a hole punch or setter mounted in said axially extending hole is removably held in place such that when said impact force is delivered to the second end of the elongated handle, said impact force is transferred to said hole punch or setter; and a storage apparatus comprising a cylindrical base having a top, a bottom, and a side wall, a main hole in the top of said base adapted to receive said handheld combination hole puncher and eyelet setter tool such that said handheld combination hole puncher and eyelet setter tool is maintained in an upright position, and a plurality of secondary holes in the top of said base, each of said secondary holes adapted to receive one of said plurality of hole punches and setters.

17. The hole puncher and eyelet setter kit of claim 16 wherein said storage apparatus further comprises a cover, said cover being cylindrical in shape having a closed top and an open bottom, said cover being transparent.

18. The hole puncher and eyelet setter kit of claim 17 wherein said cover comprises a threaded portion and wherein the cylindrical base further comprises a set of threads in the side wall, said threaded portion of the cover adapted to rotatably engage the set of threads in the side wall of the base.

19. The hole puncher and eyelet setter kit of claim 16 wherein the base is comprised of foam.

20. The hole puncher and eyelet setter kit of claim 16 wherein the main hole is located in the center of the base and the secondary holes are circularly arranged around the main hole.

* * * * *